United States Patent [19]

Lukich et al.

[11] Patent Number: 4,694,518

[45] Date of Patent: Sep. 22, 1987

[54] CABINET HAVING A RETRACTABLE BED

[76] Inventors: James L. Lukich, 9252-2 Mast Blvd., Santee, Calif. 92071; John Zarkovacki, 558 E. El Norte Pkwy., Escondido, Calif. 92025

[21] Appl. No.: 878,812

[22] Filed: Jun. 26, 1986

[51] Int. Cl.[4] ..... A47C 19/06

[52] U.S. Cl. ..... 5/136; 5/159 R; 5/160; 5/164 B; 5/2 R; 312/237

[58] Field of Search ..... 5/133, 136, 159 R, 160, 5/161, 164 R, 164 B, 2 R; 312/237

[56] References Cited

U.S. PATENT DOCUMENTS

| | | | |
|---|---|---|---|
| 428,212 | 5/1890 | Jacobson | 5/159 R |
| 640,022 | 12/1899 | Pepper | 5/164 B |
| 716,026 | 12/1902 | Geisel | 5/161 |
| 763,358 | 6/1904 | Brandt | 5/160 |
| 892,348 | 6/1908 | Baigne | 5/160 |
| 940,038 | 11/1909 | Lyons | 5/136 |
| 1,239,540 | 9/1917 | Taylor | 5/136 |
| 1,359,337 | 11/1920 | Culbertson | 5/133 |

FOREIGN PATENT DOCUMENTS

| | | | |
|---|---|---|---|
| 642436 | 6/1928 | France | 5/164 R |
| 1032964 | 7/1953 | France | 5/160 |

*Primary Examiner*—Alexander Grosz
*Assistant Examiner*—Michael F. Trettel
*Attorney, Agent, or Firm*—Charles C. Logan, II

[57] ABSTRACT

A cabinet having a retractable bed formed from the two major components of a bed frame and a cabinet having a chamber therein for pivotally receiving the bed frame. The structure for pivotally mounting the bed frame is a pair of coiled torsion springs. These springs are mounted on a rod member whose opposite ends are secured to the side walls of the cabinet frame. The coiled torsion springs have a laterally extending leg member that is detachably captured by structure in the bed frame. These coiled torsion springs also have a second leg member and it is secured to structure for preventing the rotation of that end of the coiled torsion spring about the rod member. A vertically oriented headboard and a vertically oriented footboard each have one of their vertical edges pivotally hinged to the front edge of the side walls of the cabinet frame. In their closed position they appear as part of the front face of the cabinet, but when pivoted outwardly they function as the headboard and footboard respectively of the bed. Retractable legs are mounted on the bottom of the bed frame. A shelf assembly may be located above the top wall of the cabinet frame.

7 Claims, 6 Drawing Figures

CABINET HAVING A RETRACTABLE BED

BACKGROUND OF THE INVENTION

The invention relates to a piece of furniture and more specifically to a cabinet type of furniture piece having a retractable bed disposed therein.

In the past various forms of furniture have been built having retractable folding bed structure. An example of some of the structures is illustrated in U.S. Pat. No. 2,671,230 to Potter, U.S. Pat. No. 2,672,624 to Giuseffi and in U.S. Pat. No. 3,235,888 to Nystrom. Each of these structures have different mechanical hardware that allows the bed frame to be folded back into the open chamber of the cabinet. While all of these structures are functional, there is always room for a better structure.

It is an object of the invention to provide a cabinet having a retractable bed with unique structure for pivoting the bed frame with respect to the cabinet frame.

It is also an object of the invention to provide a novel cabinet having a retractable bed that is economical to manufacture and market.

It is another object of the invention to provide a novel cabinet having a retractable bed that provides the bed with a headboard and a footboard that are hingedly attached to the front of the cabinet itself.

It is an additional object of the invention to provide a novel cabinet having a retractable bed that provides the appearance of a fine quality piece of carbinetry.

SUMMARY OF THE INVENTION

Applicant's novel cabinet having a retractable bed is formed from two primary structures. The first structure is an upright cabinet frame having laterally spaced side walls, a top wall and a bottom wall. These walls form an opening or chamber into which the bed frame may be pivoted to its retracted position.

Hingedly attached to the front edge of the respective side walls of the cabinet frame is a headboard and a footboard. When the bed is in its retracted position, the headboard and footboard present the appearance of the front face of a cabinet. From an external appearance, the headboard and footboard have false structure giving them the appearance of drawers and cabinet doors.

The structure for pivotally mounting the bed frame to the cabinet frame is quite simple to assemble. A square tubular rod has its opposite ends supported in mounting plates that are attached to the interior surface of the respective side walls of the cabinet frame. A pair of coiled torsion springs have the tubular rod pass through their center. Each of the coiled torsion springs has a leg that extends laterally therefrom and this is detachably captured by structure mounted in the bed frame. The opposite end of the coiled torsion spring has a second leg and this is secured to a tubular sleeve which in turn is rigidly mounted on the tubular rod and has structure for preventing rotational movement of this leg of the coiled torsion spring with respect to the square tubular rod.

When it is desired to utilize the piece of furniture as a bed, it is merely necessary to pivot the head board and foot board members outwardly which provides access to the bottom of the bed frame. A pulling motion along the top edge of the bed frame will cause it to pivot downwardly to a horizontal position. At this time the torsion spring is placed in tension and the weight of the bed frame itself will maintain it in its horizontal position.

A limited amount of force is necessary to lift the bed upwardly to return it to its retracted position due to the tension force maintained by the coiled torsion spring.

DESCRIPTION OF THE PREFERRED EMBODIMENT

Figure 1:
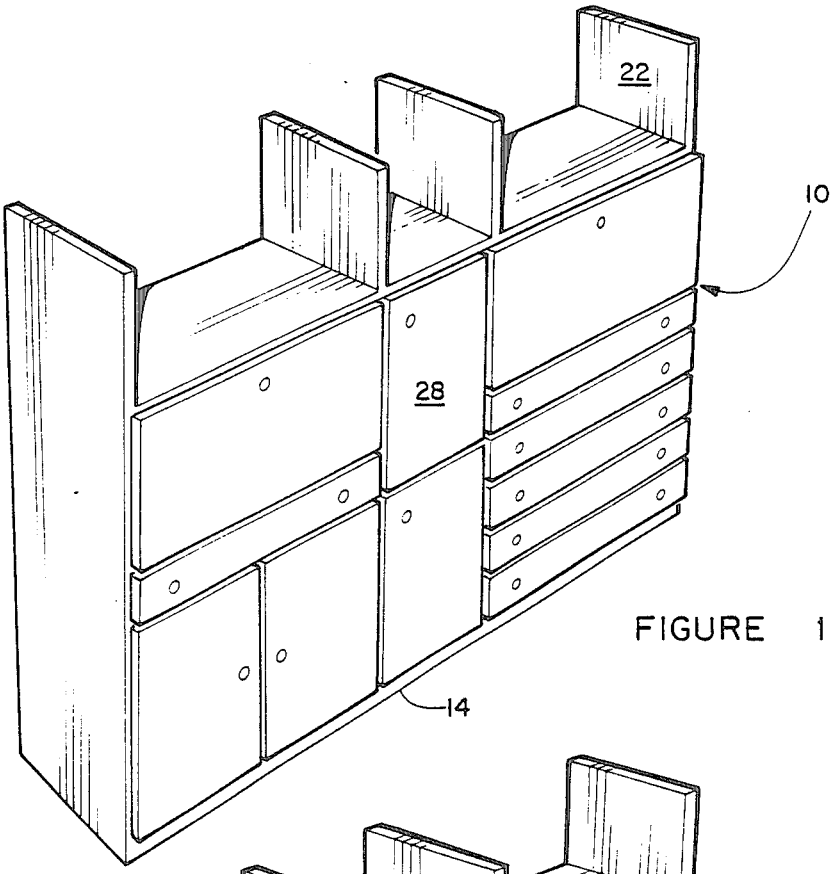
FIG. 1 is a perspective view of applicant's novel cabinet having a retractable bed.
Figure 2:
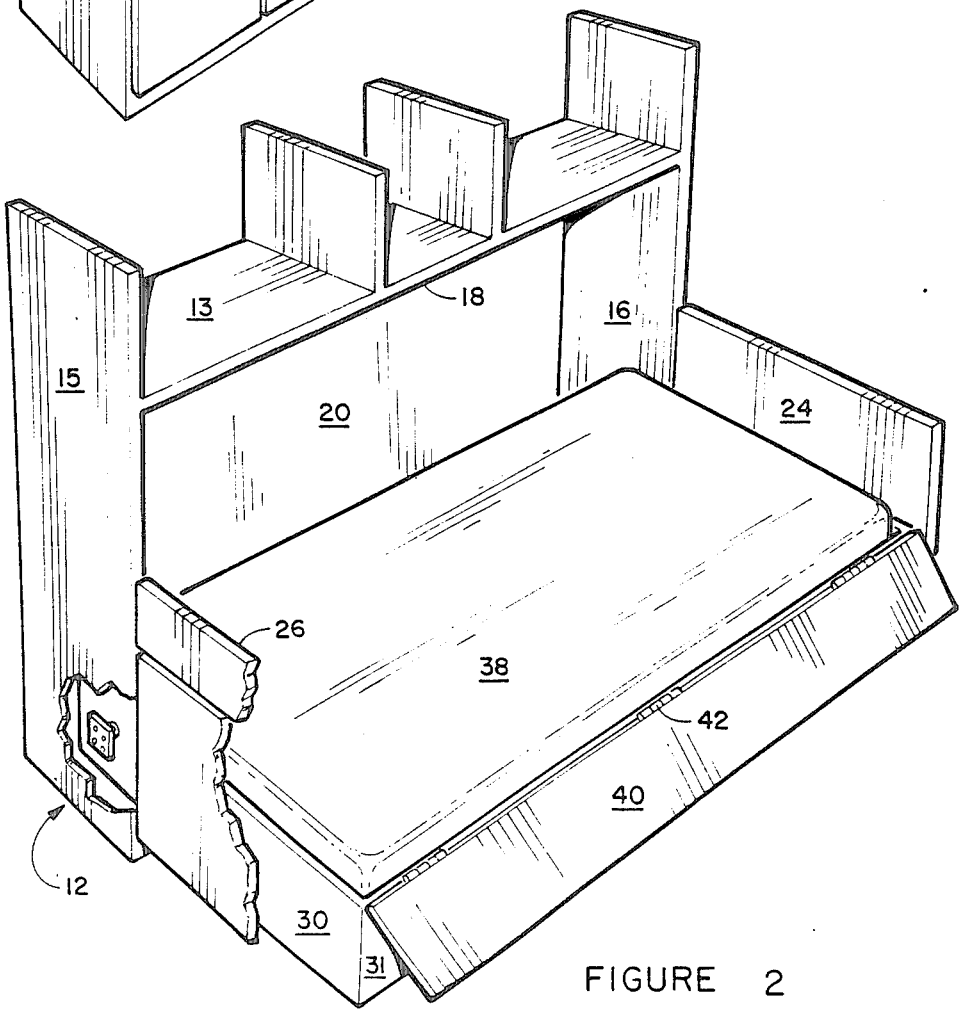
FIG. 2 is a perspective view of the cabinet illustrating the retractable bed frame in its horizontal position.

Applicant's novel cabinet having a retractable bed is generally designated numeral 10 and will be described by referring to FIGS. 1–4 of the drawings.

Cabinet 10 has a cabinet frame 12 having a top wall 13, a bottom wall 14, and side walls 15 and 16. These walls form an opening or chamber 18. Cabinet frame 12 also has a rear wall 20. A shelf assembly 22 is formed on the top of cabinet frame 12.

The front face of the cabinet frame has a head board 24 and a foot board 26 pivotally hinged thereto. A bottom frame member 28 would also be visible when the bed frame is in its retracted position.

The bed frame 30 has a front wall 31, a rear wall 32, and side walls 33 and 34. Bottom frame member 28 has its opposite ends connected to the front wall 31 and rear wall 32 along their bottom edges. A bottom wall 36 is mounted on the top of bottom frame member 28 and it provides a support for the mattress 38. A fold up gate 40 is attached by piano hinges 42 to the top edge of front wall 31.

Attached to the bottom surface of bottom wall 36 are leg assemblies 42. These have a cut out portion 43 and have a leg 44 that is pivotally hinged therein. The legs drop downwardly when the bed frame is pulled down to its horizontal position.

Figure 3:
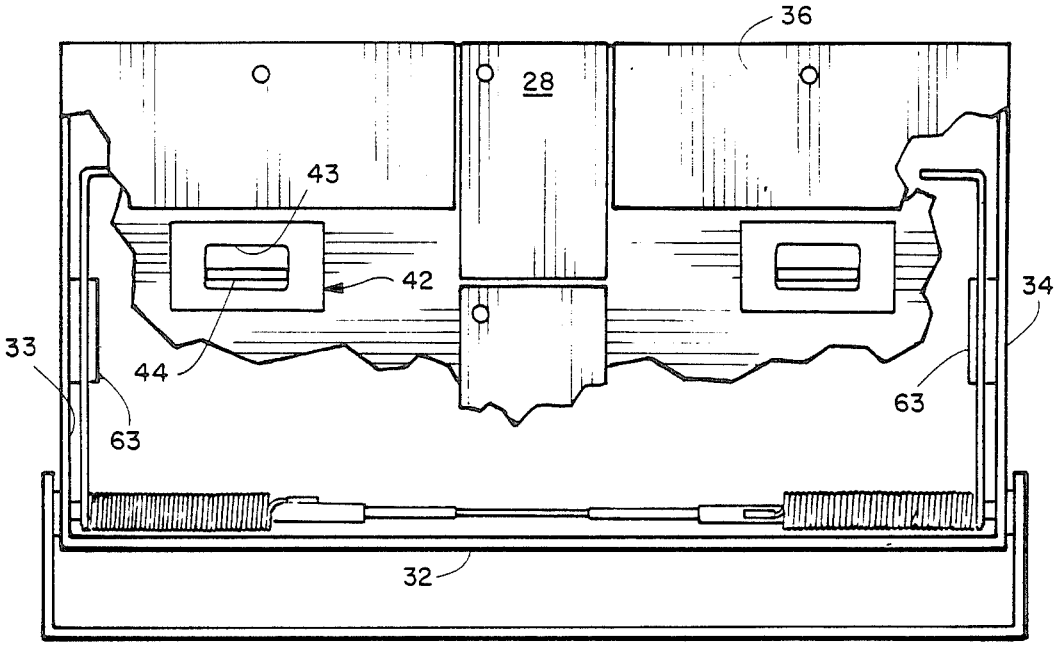
FIG. 3 is a bottom plan view of the cabinet.
Figure 4:
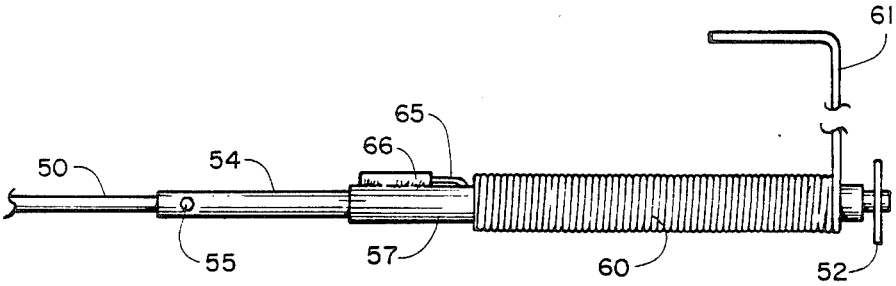
FIG. 4 an enlarged view of the coiled tortion spring structure and its manner of attachment to the cabinet frame.
Figure 5:
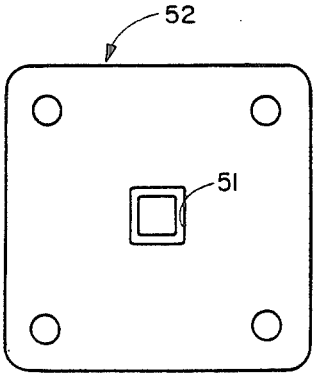
FIG. 5 is a front elevation view of the plate for mounting the square tubular rod.
Figure 6:
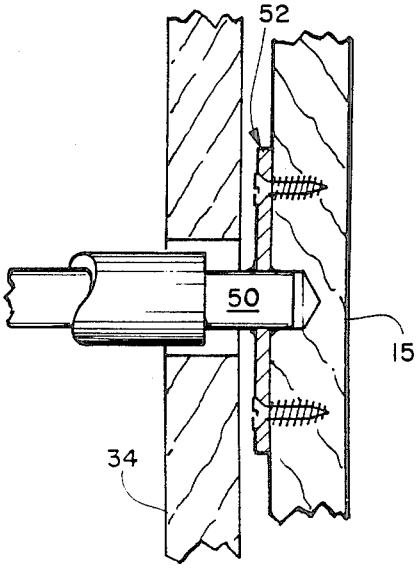
FIG. 6 is a cross sectional view of the mount plate attached to the cabinet frame.

The structure for pivoting the bed frame 30 about the cabinet frame 12 is illustrated in FIGS. 3 and 4. A square tubular rod 50 has its opposite ends supported in square apertures 51 formed in plates 52 that are attached to the inside surface of the side walls 15 and 16. A square tubular sleeve 54 telescopes over tubular rod 50 and is secured thereto by a set screw 55. A snuggly fitting tubular sleeve 57 is telescopically slid over square tubular sleeve 54 and is frictionally held therein so that it cannot rotate with respect to it. Coiled torsion springs 60 are telescopically mounted over tubular sleeves 57 and they each have a leg 61 extending laterally therefrom that is detachably captured beneath the block 63 mounted on the inside of the sidewalls of the bed frame. The opposite ends of the coiled torsion springs 60 have a leg 65 that is captured in a tubular sleeve 66 that is welded to tubular sleeve 57.

What is claimed is:

1. A cabinet having a retractable bed comprising:

a cabinet frame having a pair of laterally spaced upstanding side walls being of a predetermined height and having a top end and a bottom end, a bottom wall having opposites ends that are connected to said side walls adjacent their bottom ends, a top wall having opposite ends that are connected to said side walls at a predetermined height, said walls forming a chamber for receiving a bed frame, the walls of said cabinet frame each having a front edge;

a bed frame having laterally spaced side walls, a front wall and a rear wall; and torsion spring means for pivotally mounting said bed frame in said cabinet frame so that said bed frame can be pivoted from a vertical stored position to a horizontal position, said torsion spring means comprises a square rod member having opposite ends that are rigidly supported in square apertures formed in two plates that are attached to opposing inside surfaces of the side walls of said cabinet frame, a square tubular sleeve telescoped over said tubular rod and secured thereto by a set screw, a snug fitting round tubular sleeve telescopically slid over said square tubular sleeve and frictionally held so that the two members cannot rotate with respect to each other, said round tubular member passing through aligned apertures in the side walls of said bed frame so that said bed frame can be pivoted thereabout, at least one coiled torsion spring mounted on said round tubular member, said torsion spring having a laterally extending leg member that is detachably captured by a stop on said bed frame, said coiled torsion spring having a second leg that is structurally secured to said round tubular member to prevent it from pivoting with respect to said round tubular member.

2. A cabinet having a retractable bed as recited in claim 1 further comprising a vertically oriented head board having one side pivotally hinged to the front edge of one of said side walls of said cabinet frame.

3. A cabinet having a retractable bed as recited in claim 2 further comprising a vertically oriented foot board having one side pivotally hinged to the front edge of one of said side walls of said cabinet frame.

4. A cabinet having a retractable bed as recited in claim 1 wherein said cabinet frame has a rear wall.

5. A cabinet having a retractable bed as recited in claim 1 wherein said bed frame has a cross member connecting the front and rear walls and this cross member forms a portion of the front face of the cabinet when said bed frame is in its stored position.

6. A cabinet having a retractable bed as recited in claim 1 further comprising a foldup gate hinged to the front wall of said bed frame.

7. A cabinet having a retractable bed as recited in claim 1 further comprising a shelf assembly located above the top wall of said cabinet frame.

* * * * *